United States Patent [19]

Kubo

[11] Patent Number: 4,651,832

[45] Date of Patent: Mar. 24, 1987

[54] FLASH TYPE SPRINKLER HEAD

[76] Inventor: Masanove Kubo, 2-22 Kosada 3-chome, Hashimoto-shi, Wakayama-prefecture, Japan

[21] Appl. No.: 623,761

[22] Filed: Jun. 20, 1984

[30] Foreign Application Priority Data

Jun. 23, 1983 [JP] Japan ..... 58-97457[U]
Jun. 23, 1983 [JP] Japan ..... 58-97458[U]

[51] Int. Cl.[4] ..... A62C 37/12; A62C 37/30
[52] U.S. Cl. ..... 169/39; 169/42
[58] Field of Search ..... 169/37–42, 169/56, 57

[56] References Cited

U.S. PATENT DOCUMENTS

| | | | |
|---|---|---|---|
| 313,724 | 3/1885 | Granger | 169/40 |
| 2,004,833 | 6/1935 | Rowley | 169/38 |
| 2,553,726 | 5/1951 | Rowley | 169/42 X |
| 3,348,617 | 10/1967 | Macartney | 169/39 X |
| 3,716,103 | 2/1973 | Tanaka et al. | 169/42 |
| 4,015,665 | 4/1977 | Simons et al. | 169/40 |

FOREIGN PATENT DOCUMENTS

| | | | |
|---|---|---|---|
| 1100471 | 2/1961 | Fed. Rep. of Germany | 169/41 |
| 23895 | 2/1977 | Japan | 169/40 |
| 53-8239 | 3/1978 | Japan . | |
| 56-49636 | 11/1981 | Japan . | |
| 97565 | 6/1982 | Japan . | |
| 58-1333 | 1/1983 | Japan . | |

*Primary Examiner*—Joseph F. Peters, Jr.
*Assistant Examiner*—Mary Beth O. Jones
*Attorney, Agent, or Firm*—Wenderoth, Lind & Ponack

[57] ABSTRACT

A flash type sprinkler head which includes a main body including an upper portion for connection to a water pipe and a lower portion having an outlet, a valve member which includes a valve cap and a gasket for releasably closing the outlet, a heat sensitive member which disassembles in response to the heat of a fire, a guide pin mounted on the heat sensitive member received in a lower end of the valve member, a frame screwably fixed to the main body, surrounding the outlet and the valve member, the frame supporting the heat sensitive member on a step portion formed on a lower inner surface thereof, a spring between the guide pin and the heat sensitive member which presses the valve member upward to seal the outlet in response to upward pressure applied by the frame through the heat sensitive member, and a heat conductive plate which protectively surrounds the heat sensitive member. The plate is separated from the frame by only a slight gap so as to abut the lower end of the frame if impacted from below. The heat sensitive member includes a fusible segment between a head portion and a cylinder which flows out from the cylinder when it melts.

7 Claims, 18 Drawing Figures

FLASH TYPE SPRINKLER HEAD

The present invention relates to a flash type sprinkler head. More particularly, it relates to a flash type sprinkler head for a building having a small exposed portion on the ceiling and having such a construction that a detachable member which fixes a valve for stopping water in the absence of fire and a material of relatively low melting temperature supporting the same, on the outbreak of fire, slide downward in the main body of the sprinkler head due to the melting of the material (hereinafter referred to as a fusible segment) so as to operate the valve and release the water.

BACKGROUND OF THE INVENTION

In the latest style of building, for the purpose of increasing efficiency of utilization of construction materials and efficiently utilizing the space in the room by making the ceiling as low as possible, there is a tendency to use a flash type sprinkler head which has fewer portions left open to view on the ceiling board. Since this flash type sprinkler head contains a setting portion having a smaller diameter than that of the head-setting hole provided on the ceiling board, it is advantageously possible to set the sprinkler head onto the sprinkler piping before boarding the ceiling, and therefore this type of sprinkler head has a great advantage, which does not exist in the other type of sprinkler head, that the work of mounting or setting the same to the sprinkler piping in each room in the building can be effected before and without being influenced by the process of boarding the ceiling.

As the conventional flash type sprinkler heads, there are shown some examples in Japanese Utility Model Publication (examined) Nos. 8239/1978 and 49636/1981 and Japanese Utility Model Publication (unexamined) No. 97565/1982, which are shown in FIGS. 1, 2 and 3 of the accompanying drawing, respectively.

An explanation is now made of the fundamental construction and operation of a conventional flash type sprinkler head with reference to FIG. 1. In FIG. 1, the sprinkler head comprises a main body 1, a valve member 7 which is installed on the tip opening portion of the main body 1, i.e., a drain opening portion, and a heat sensitive detachable member 15 which can sense the heat of flames to disassemble and scatter. The main body 1, which has a downwardly decreasing internal diameter, mainly comprises a connecting pipe portion and a straight pipe portion at the upper and lower halves thereof. The connecting pipe portion is provided, on its outer side, with male screw threads which connects to the sprinkler piping, and the straight pipe portion, has a drain opening portion on its lower end. On the outer periphery of the upper end of the straight pipe portion, there is formed a flange having a male screw member 1' for connection to a cylindrical frame 2 to screw-fix the cylindrical frame 2 to the main body with the cylindrical frame 2 to the main body with the cyldrical frame hanging downward. On the outside of the straight pipe portion there is fixed a deflector ring 6, and a deflector 5 of the drain opening is connected through the connecting leg of the deflector ring 6. The portion of the deflector 5 provided on the lower portion of the drain opening contains the valve member 7 which closes the end surface of the drain opening and is held by the heat sensitive detachable member on the lower end of the frame.

The valve member 7 which comprises a gasket 3 made of copper packing, etc. and a valve cap 4 covered with the gasket is installed on the valve seat on the tip end of the drain opening. On the setting-up of the sprinkler head the tightening force of the frame 2 onto the flange is converted into a pressing force by which the valve cap 4 closes the end surface of the drain opening.

The heat sensitive detachable member 15 contains a pair of levers 10 which are hooked on an inwardly directed flange on the lower end of the frame 2, a setting plate 11 which is positioned on the upper portion of the levers and supported by the levers 10 which are inserted therethrough, a balancer 12 which is positioned at the lower portion of the levers 10, a heat sensitive cylinder 13 which is inserted through the setting plate 11 and held with the balancer 12, a heat sensitive (heat conductive) piston 14, a heat sensitive (heat conductive) plate 16 which contains said heat sensitive cylinder 13 and the heat sensitive piston 14 and is provided hanging on the lower end of the frame 2, and a fusible segment 17 formed of a material which melts when exposed to the heat of a fire, which is held between the heat sensitive cylinder 13 held to the balancer 12 against the tightening force of the frame 2 and the heat sensitive piston 14 screwed to the setting plate 11.

As soon as the heat sensitive plate 16, the heat sensitive cylinder 13 and the heat sensitive piston 14 sense the heat generated by fire and the fusible segment made of an alloy having low melting point is melted, the balance of the tightening force between the heat sensitive piston 14 and the heat sensitive cylinder 13 which support the fusible segment 17 and the frame 2 is broken, whereby the heat sensitive piston 14, the heat sensitive cylinder 13 and the heat sensitive plate 16 are pushed upward by the levers 10 and the balancer 12. Then the levers 10 are rotated outward so as to disconnect both ends of the balancer 12 from the jointing hole portion of the levers 10, and thereby the setting plate 11 is also free from the levers 10. Thus, each element of the heat sensitive detachable member 15 falls down while disassembling and scattering. Accordingly, the valve member 7, the deflector 5 and the deflector ring 6, which are out of the supporting elements at the lower end, move downward inside the frame 2, and the deflector ring 6 is then set on the inwardly directed flange at the lower opening portion of the frame 2 so as to support the deflector 5 in a hanging disposition. As a result, the pressurized water in the sprinkler piping spouts out from the drain opening from which the valve member 7 is removed and dashes against the deflector 5, whereby the water scatters in all directions so as to extinguish the fire. This process from the sensing of heat to the drainage is almost instantaneously effected.

In the conventional sprinkler head having a construction as described above, the transmission of heat to the fusible segment from the other heat sensitive elements in the heat sensitive detachable member can afford the sprinkler head to sense the fire, and the fusible segment is melted to release the drain opening of the tip end of the sprinkler piping so as to scatter the pressurized water. In the thus constructed sprinkler head, however, as shown in FIGS. 1 and 2, since the heat sensitive plate 16 has no perforations on its lower surface, peripheral wall or connecting portion, it is impossible to observe the condition of the fusible segment 17, which is completely surrounded with the heat sensitive plate 16, without removing the heat sensitive plate 16. Accordingly, changing conditions of the fusible segment or the surroundings of the same with the lapse of time cannot be observed. Another disadvantage is as follows: since the fusible segment of said sprinkler head is compressed by the tightening and pressing force of the heat sensitive cylinder 13 and the heat sensitive piston 14 which are supported by the levers 10 and the balancer 12, while maintaining the balance [12, while maintaining the balance] with the tightening force of the frame 2 against the flange 1' of the main body, the sizes of the detachable member and the heat sensitive member is necessarily long in the vertical direction. Thus, there is a need for a smaller sprinkler.

SUMMARY OF THE INVENTION

An object of the present invention is to provide a flash type sprinkler head in which the area of the exposed portion of the ceiling is made smaller than ever so that said exposed portion is unlikely to be hit by any external substances, and can be strengthened against an externally applied shock.

Another object of the present invention is to provide a flash type sprinkler head in which a small outlet for the fusible segment is provided on the heat sensitive member in order to permit visual observation of the condition of the fusible segment from the outside, whereby the lifetime of the sprinkler head can easily be observed.

For attaining the above objects, the size of the flash type sprinkler head of the invention is made smaller by providing a construction in which the balancer supporting the lever in the heat sensitive detachable member is usually pulled upward and, when it senses heat, it can move downward. Further, the area of the exposed portion of the sprinkler head on the ceiling board can be made smaller by providing the heat sensitive plate in close contact with the frame surrounding the valve member provided with the main body, whereby the strength of the sprinkler head against external shock can be increased.

Further, in the sprinkler head of the invention, the valve member and the guide pin supporting the same are inserted into the inner side of the drain opening portion of the straight pipe portion so as to prevent the valve member from slipping out of its place and prevent the leakage of the pressurized water.

Furthermore, the small outlet for the fusible segment to flow out is provided on the projecting portion of the sprinkler head on the ceiling board, and thereby it is possible to visually observe from the outside the occurrence of an unusual change in the fusible segment.

Furthermore, the present invention provides a protecting cap and a sealing plate which are suitable for the flash type sprinkler head of the present invention.

DETAILED DESCRIPTION OF THE PREFERRED EMBODIMENTS

The preferred embodiments of the present invention will be explained in detail with reference to the accompanying drawings.

Figure 1:
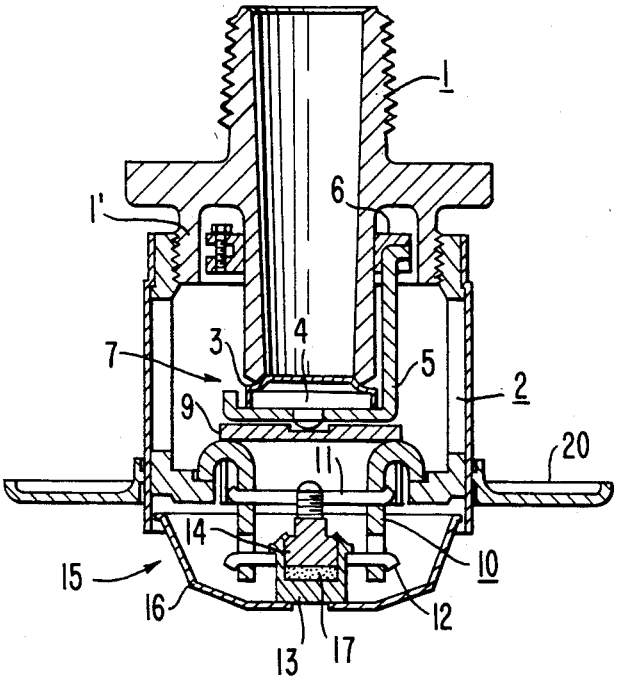
FIG. 1. (PRIOR ART)
FIGS. 1, 2 and 3 are vertical sectional views showing the conventional sprinkler heads, respectively.
Figure 2:
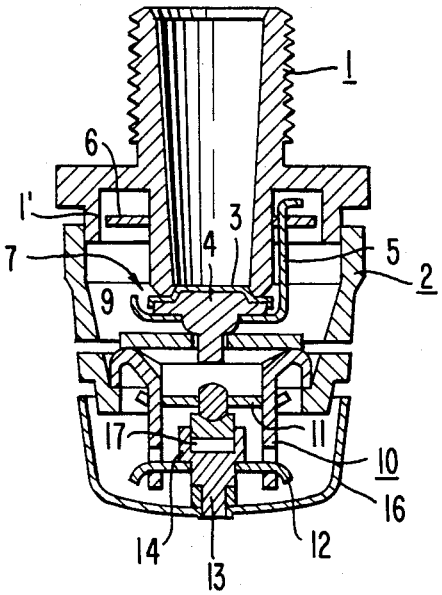
FIG. 2. (PRIOR ART)
Figure 3:
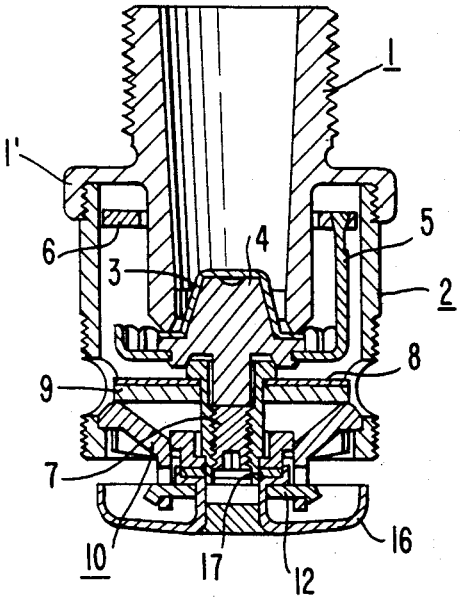
FIG. 3. (PRIOR ART)
Figure 4:
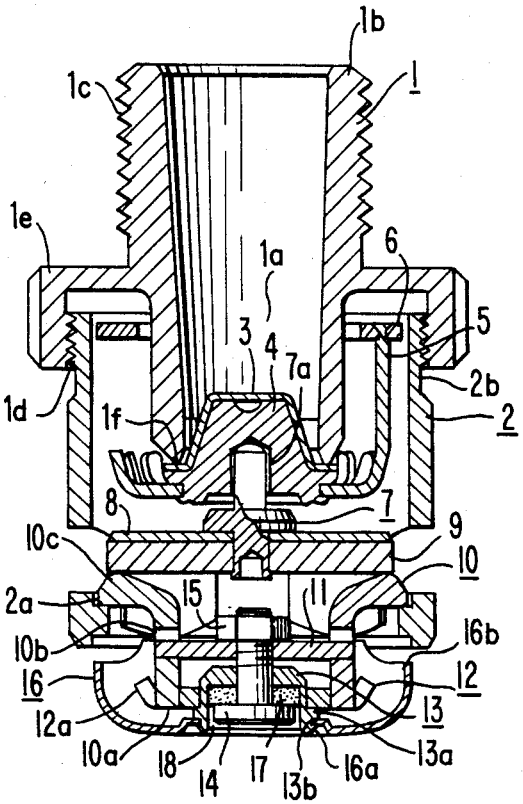
FIG. 4 is a vertical sectional view showing an embodiment of the flash type sprinkler head according to the present invention.

As shown in FIG. 4 which shows one embodiment of the flash type sprinkler head of the present invention, the sprinkler head comprises a main body 1 for being connected with a sprinkler piping, a valve member surrounded by a frame 2 installed at the tip of said main body, and a heat sensitive element which is protected and covered with a heat sensitive (heat conductive) plate 16 fixed by contacting the upper end thereof with the lower opening portion of said frame 2. The main body 1 comprises a tubular case 1*b* having a drain opening portion 1*a* of downwardly decreasing diameter at its lower end, screw threads 1*c* for connecting with a sprinkler piping, provided on the outer wall of the tubular case 1*b*, and a brim portion 1*e* which is provided, on its inner periphery, with screw threads 1*d* for screw-fixing the frame 2.

The valve member, which comprises a gasket 3 and a valve cap 4, is supported with a deflector 5 and a deflector ring 6. The upper end of the valve member is inserted into the drain opening portion 1*a* with the use of a guide pin 7 screwed into the valve cap 4 and a guide post 8 provided with the guide pin 7, through a plate spring 9.

Figure 5:
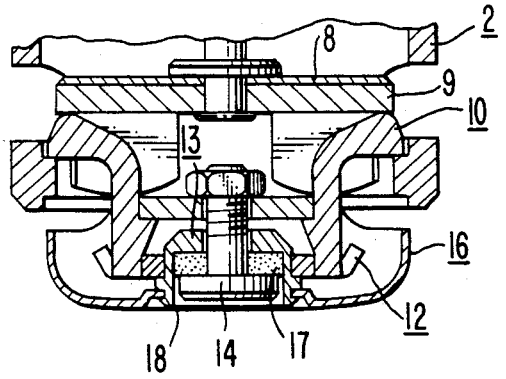
FIG. 5 is a vertical sectional view showing another embodiment of the flash type sprinkler head in its essential part.

As shown in FIGS. 4 and 5, the heat sensitive element comprises two bending levers 10, a setting plate 11, a balancer 12, a heat sensitive (heat conductive) cylinder 13, a heat sensitive (heat conductive) piston 14, and a fusible segment 17. Each lever 10 has such rotation torque that the tightening force generated by the frame 2 being screwed into the screw threads 1*d* of brim 1*e* acts on the outer end of the bending portion 10*c* of the lever 10 to be pressed on the lower, inwardly directed step portion 2*a* of the frame 2 and thereby the lower end portion 10*a* of each lever 10 is rotated outward. The setting plate 11 is connected with the connecting portion 10*b* of each lever 10. The balancer 12 forcibly receives and counteracts the rotation torque of the lower end portion 10*a* of each lever 10, which is produced by the tightening force of the main body and the frame 2 and another force suppressing rotation with a spring 9 engaging the bending upper end surface of the bending portion 10*c* of each lever supported by the frame 2. The fusible segment 17 is pressed and sealed inside the heat sensitive cylinder 13 with the heat sensitive piston 14 and the nut 15. The connecting portion 10*b* of the lever 10 may have various shapes and constructions, and for example, a connecting hole as shown in FIG. 4 or connecting claw as shown in FIG. 5 may be used. Between the heat sensitive cylinder 13 and the heat sensitive piston 14 is provided a gap 18, which is used as an outlet for the fusible segment, provided that, a part of the fusible segment 17 also flows out from a gap between the vertically extending rod hole in the heat sensitive cylinder 13 and the vertical rod of the heat sensitive piston 14.

The thick bending portion 10*c* of each lever 10 presses against the spring 9, i.e., the guide pin 7 so as to press the gasket 3 and the valve cap 4 of the valve member in the upward direction. The tip end 7*a* of the guide pin 7 is inserted in the hole in the valve cap 4 to reach a position closer to the sprinkler piping than the valve seat 1*f* at the lower end of the opening portion 1*a* so as to strengthen the valve cap 4 in the upper direction. The lower end 10*a* of each lever is in a shape of a claw. On the balancer 12 is provided claw-shaped projections 12*a*, bending upward, which hold the claws of the lower ends 10*a* of the levers and are used for receiving the outward forces of the levers 10. The balancer 12 is set on the lower end of each lever 10 in such a manner that it can freely be set or removed.

Figure 6:
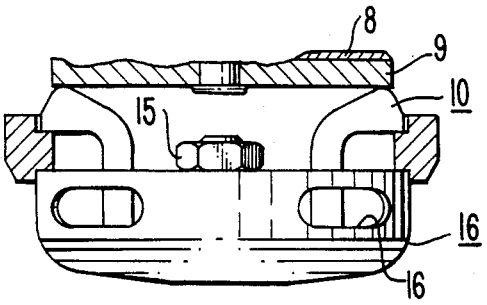
FIG. 6 is a side and partially vertical sectional view showing a cut-in hole portion provided on the heat sensitive plate in the sprinkler head of FIG. 4.

The heat sensitive plate 16 has a closed edge surrounding and therefore defining an opening portion 16*a*, on its bottom portion, which has a diameter corresponding to the outer diameter of the heat sensitive cylinder 13. Onto the brim-shaped projection 13*a* of the opening side portion of the heat sensitive cylinder 13 is fixed the opening portion 16*a*, the surrounding closed edge of the opening portion 16*a* extending into a peripheral groove 13*b* in cylinder 13. As shown in FIG. 6, the heat sensitive plate 16 has a cut-in hole 16*b* on its side to be in close contact with the frame 2 or to be fixed thereto with a small gap.

In the above described flash type sprinkler head of the present invention, under the usual condition when it is responsive but not responding to fire, on the tip end 1*f* of the drain opening portion 1*a* of the main body 1 which is connected with the sprinkler piping, the gasket 3 and the valve cap 4 are pressed and strengthened with the guide pin 7, whereby the drainage of pressurized water is controlled. Since the fusible segment 17 in the heat sensitive member is always compressed by the heat sensitive cylinder 13 and the heat sensitive piston 14, when the heat sensitive member senses the heat and the fusible segment is melted, the melted fusible segment flows out from the outlet 18. Then the heat sensitive cylinder and the heat sensitive plate 16 move downward, and according to this movement, the balancer 12 supported on the upper surface of the brim-shaped projection 13*a* of the heat sensitive cylinder 13 is free from the connection with the lower end portion 10*a* of each lever 10. As a result, each lever 10 is moved out of the frame 2 due to the rotation torque operating outward, and thereby the heat sensitive member is disassembled and scattered around. Then, the spring 9, the guide 8 and the guide pin 7 which have lost their support fall down with the levers 10.

Subsequently, the gasket 3 and the valve cap 4 which are hung down on the deflector ring 6 by the deflector are fixed on the tip end 1*f* of the sprinkler head by the action that the deflector ring 6 falls down and is fitted on the inner surface of the tip inner edge portion 2*a* of the frame 2. In this condition, the gasket and the valve cap receive and release the pressurized water discharged from the drain opening portion 1*a*, and thereby the water is scattered in all directions to extinguish the fire. Further, in the absence of fire, when the fusible segment 17 experiences creep due to deterioration caused by the compressive force thereon, a change of the atmospheric temperature and the change with the lapse of time, a part of the fusible segment 17 gradually flows out from the outlet 18, whereby the time to exchange the sprinkler head, that is, the end of the useful lifetime of the sprinkler head, can be detected easily.

Further, the sprinkler head of the present invention has another advantage not seen in the conventional sprinkler head: the provision of the cut-in hold 16*b* on the side of the heat sensitive plate 16 can afford the heat sensitive cylinder 3 the ability to sense the heat around the same so that the sensitivity of the heat sensitive member can be elevated. Since the heat sensitive plate 16 is mounted on the tip inner edge portion 2*a* of the frame 2 in such a manner that it is tightly fixed thereto or it is in close contact therewith with a small gap, even if the heat sensitive plate 16 is externally hit with an object, it has a strong resistance to an externally applied shock, as it abuts frame edge portion 2*a* as shown in FIG. 7 and does not slide upward, and thereby the heat sensitive member can be fully protected.

Figure 7:
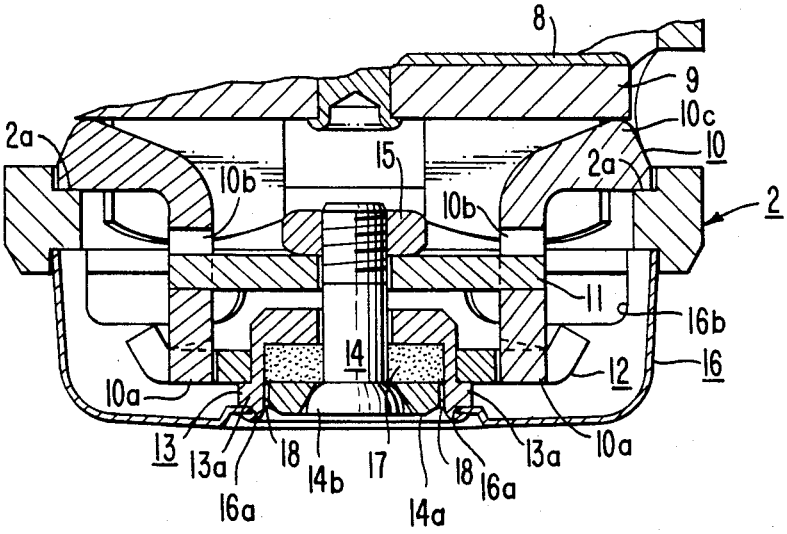
FIG. 7 is a vertical sectional view showing the essential part of the separation-type heat sensitive piston.
Figure 8A:
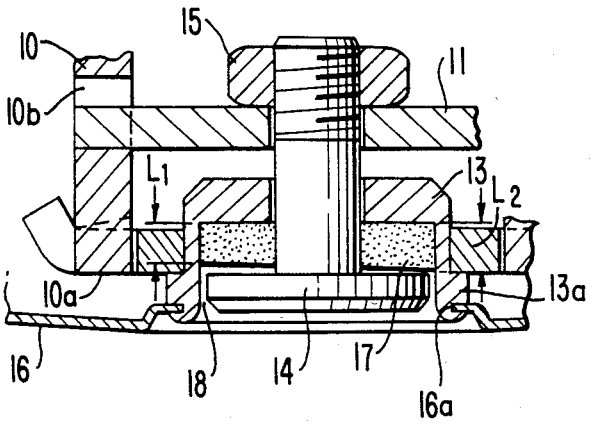
FIGS. 8(*a*) and 8(*b*) are vertical sectional views of the heat sensitive member showing an error in tightening of the heat sensitive piston and the nut.
Figure 8B:
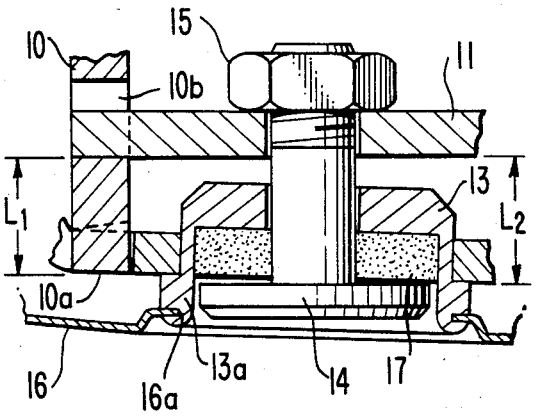
Figure 9A:
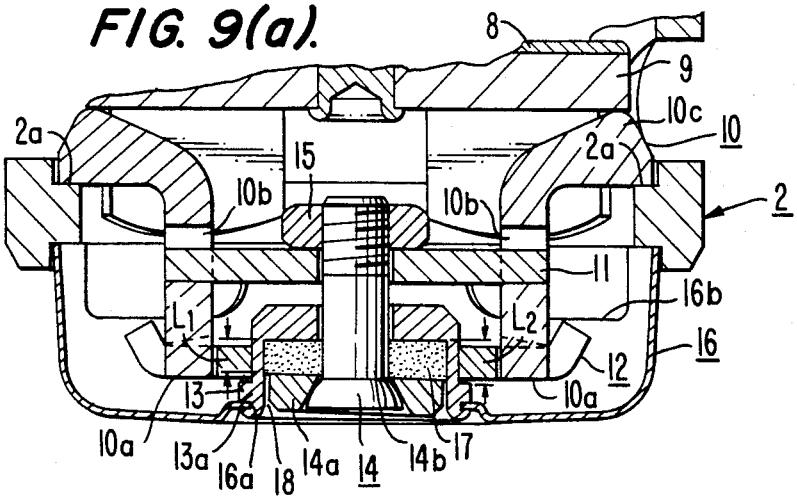
FIGS. 9(*a*) and 9(*b*) are vertical sectional views of the essential part of the sprinkler head of FIG. 4 having the separation-type heat sensitive piston, showing the fusible segment under pressure.
Figure 9B:
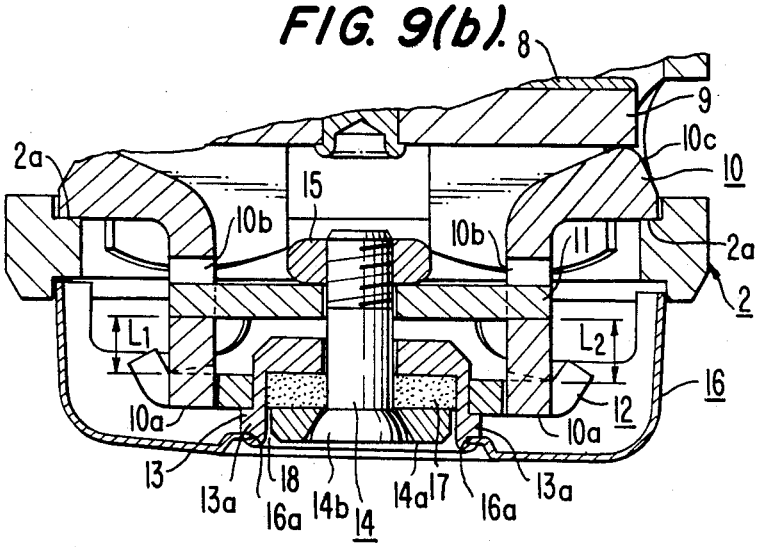

The heat sensitive piston 14, as shown in FIG. 7, is divided into a piston plate 14*a* containing a tapered hole and a rod 14*b* having a head portion which is a spherical projection, so that the heat sensitive piston is adherent to or compressed against the inclined surface of the fusible segment 17, as shown in FIGS. 9(*a*) and 9(*b*). Accordingly, there is not produced a space or a partial contact between the heat sensitive piston 14 and the fusible segment 17, which causes the occurrence of the creep on the fusible segment caused by, as shown in FIGS. 8(*a*) and 8(*b*), or error in manufacturing the heat sensitive piston 14, the nut 15 and the fusible segment 17, or an error in tightening them (an incline shown by $L_1 < L_2$).

Figure 10:
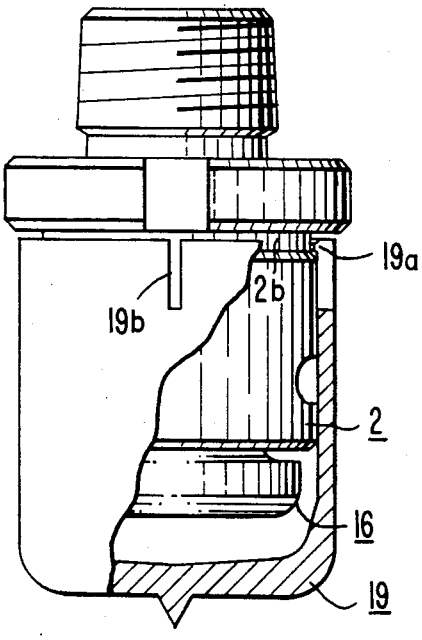
FIG. 10 is a vertical sectional view of the essential part of the sprinkler head of FIG. 4 showing the condition of a protecting cap when set.

The flash type sprinkler head of the present invention can be installed on the sprinkler piping before boarding of the ceiling. In this case, a protecting cap 19 is employed as shown in FIG. 10. The protecting cap 19 in a shape of an inverted bell has a ring-like claw 19*a* on the opening portion and a notch 19*b* on the peripheral wall of the opening portion. The protecting cap 19, which is made of elastic materials, is put on the frame by hooking the ring-like claw 19*a* on the circular, cut-in groove 2*b* of the upper portion of the frame 2, in order to prevent the protecting cap from falling. After the completion of boarding of the ceiling, the protecting cap is removed.

Figure 11:
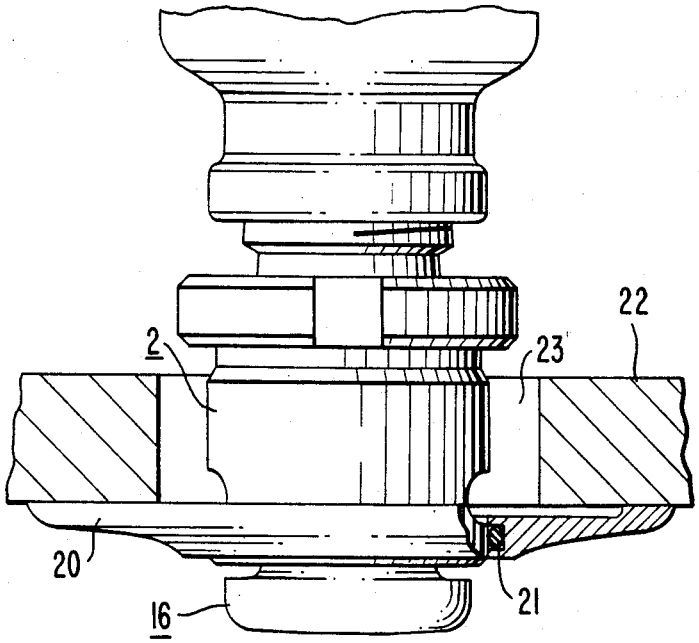
FIG. 11 is a vertical sectional view of the essential part of the sprinkler head of FIG. 4 showing the condition of a sealing plate when set.

For the purpose of covering the slit between the sprinkler head-setting hole 23 on the ceiling board 22 and the outer wall of the frame 2 of the sprinkler head as shown in FIG. 11, there may be employed a sealing plate 20 in a shape of a trapezoidal disk. On the inner surface of the sealing plate 20 is provided an elastic ring 21 which is tightly fixed to the outer wall of the frame 2 and is press-fixed on the ceiling board in such a manner that the sealing plate 20 can move up and down.

As is apparent from the above descriptions, the flash type sprinkler head has the following advantages. Since the space between the frame and the heat sensitive plate is remarkably small and a shock or impulse from the outside is hardly transmitted inside, the sprinkler head is strongly resistant to outer shock; since the projected portion of the sprinkler head on the ceiling board is small, it has a beautiful appearance and is excellent in view of the protection it provides. Further, with such a construction that the guide pin 7 is inserted in the valve cap 4 so as to extend to an upper position above the drain opening portion 1*a* of the main body 1, that is, is inserted inside of the tube 1*b* so as to put the operating point of the valve-supporting force inside the tube 1*b*, the valve member is not out of the valve seat 15 on the lower end of the drain opening portion 1*a* and thereby the leakage of water can be prevented.

Figure 12:
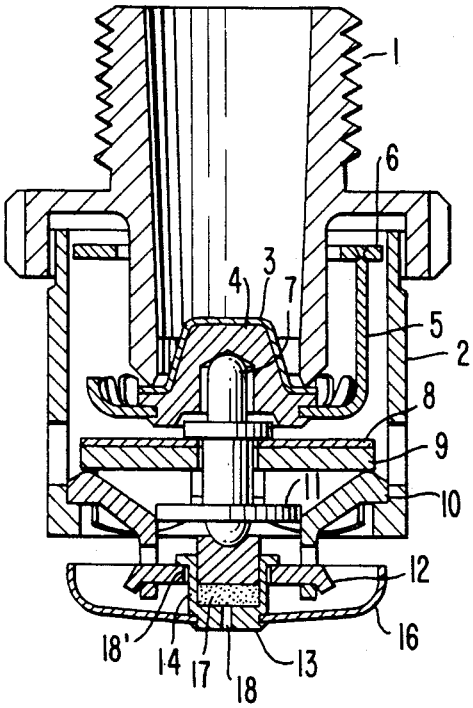
FIGS. 12 and 13 are vertical sectional views showing other embodiments of the sprinkler head using the heat sensitive element according to the present invention.

FIG. 12 shows another embodiment of the flash type sprinkler head of the present invention in which the heat sensitive plate provided with the outlet having the other purpose is used. In the sprinkler head which comprises a main body 1 connected with a sprinkler piping, a valve member comprising a gasket 3 and a valve cap 4, and a heat sensitive element comprising a heat sensitive member including a heat sensitive cylinder 13 and a heat sensitive piston 14, a fusible segment 17 maintained with said heat sensitive member, and a heat sensitive plate 16 surrounding said heat sensitive member, on the portion where the heat sensitive member faces to the outer portion of the heat sensitive plate 16, there are provided one or several outlets 18 for the fusible segment 17. In the heat sensitive member, the fusible segment 17 fills the inside of the heat sensitive cylinder 13 fixed to the balancer 12, and the cylinder 13 is sealed with the heat sensitive piston 14 and compressed upward with a guide pin 7. In FIG. 12, although an outlet 18 is provided on the center of the bottom of the heat sensitive cylinder 13, there may also be provided an outlet 18 on the exposed portion of the heat sensitive member, that is, on the portion which can be seen from the outside. The position, shape and size of the outlet 18 may be any that are suitable.

Figure 13:
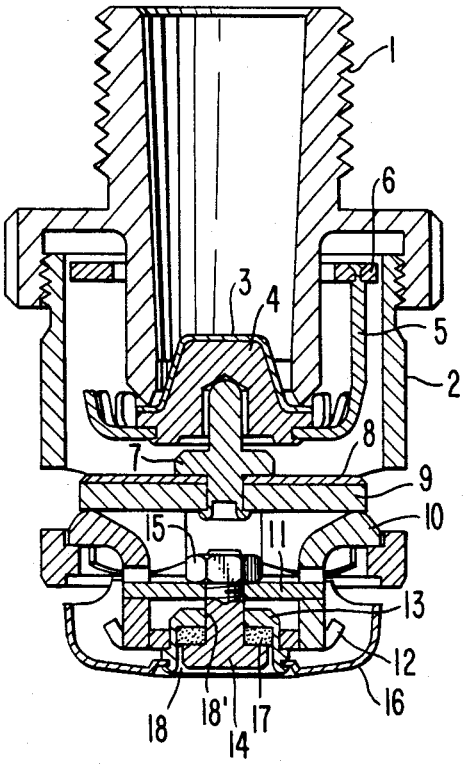

FIG. 13 shows another embodiment of the sprinkler head using the heat sensitive member of the present invention. In the heat sensitive member, the fusible segment 17 fills the inside of the heat sensitive cylinder 13. The fusible segment 17, the heat sensitive cylinder 13 and the setting plate 11 are passed through with the heat sensitive piston 14 and tightened by a nut 15. Between the heat sensitive cylinder 13 and the head portion of the heat sensitive piston 14, there is provided a gap, which is used as an outlet 18. The outlet 18 may be positioned in the inner part, i.e., in the upper part more than the one shown in FIG. 13, and it may only be seen from the outside.

Figure 14A:
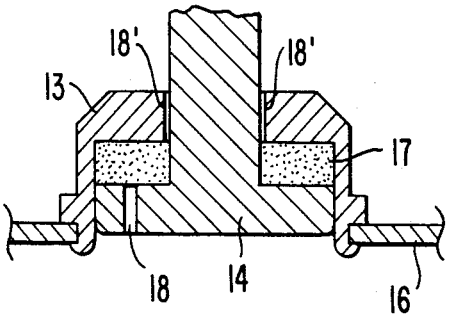
FIGS. 14(*a*), 14(*b*) and 14(*c*) are vertical sectional views showing other embodiments of the heat sensitive element according to the present invention.
Figure 14B:
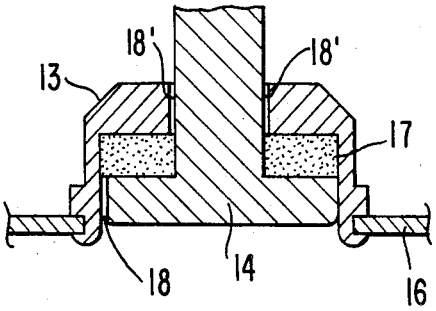
Figure 14C:
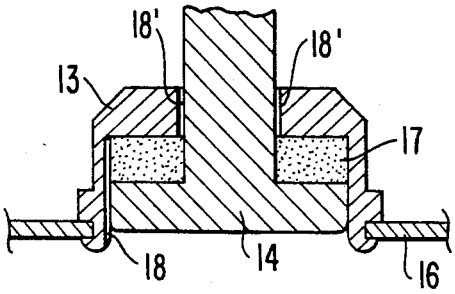

FIGS. 14(*a*)–14(*c*) show other embodiments of the outlet 18 in a heat sensitive member similar to that shown in FIG. 12. FIG. 14(*a*) shows a heat sensitive member which is provided with a passing hole on the head portion of the heat sensitive piston 14, FIG. 14(*b*) shows a heat sensitive member which is provided a notch on the head portion of the heat sensitive piston 14 and FIG. 14(*c*) shows a heat sensitive member which is provided with a notch on the inner surface of the heat sensitive cylinder 13.

In the practical usage of the above-described sprinkler head, when a fire breaks out, the heat sensitive member becomes hot with an elevating temperature, and the fusible segment 17 in the heat sensitive cylinder 13 is melted with the heat of the heat sensitive member and flows out from the outlet 18. By the separation of the balancer 12 from the levers 10, due to the torque usually operating on the levers 10, the heat sensitive member falls down and scatters, and thereby the valve member is left open so as to exhaust the pressurized water in the sprinkler piping. The pressurized water discharged from the tip end of the main body 1 dashes against the deflector 5 held inside the frame 2, and uniformly scatters around, whereby the initial extinguishing of fire can be attained. At this time, a part of the melted fusible segment 17 also flows out from the slit 18' between the heat sensitive cylinder 13 and the heat sensitive piston 14.

Further, since the fusible segment 17 is usually compressed, over a priod of time peculiar to the particular sprinkler head it leaks out in a slight amount from the outlet 18 due to the production of creep or deterioration of the fusible segment.

As mentioned above the sprinkler head of the present invention has the following advantages. The provision of the outlet 18 on the exposed portion of the heat sensitive element can afford the heat sensitive element to have excellent sensitivity when the heat sensitive element senses an elevating temperature in the atmosphere caused by a fire and the fusible segment 17 flows out from the outlet. Further, with the deterioration of the fusible segment, such as would be caused by creep, a part of the fusible segment 17 leaks out from said outlet 18. Accordingly, the condition of the fusible segment can visually be observed from the outside, as it is. Thus, the sprinkler head of the present invention is excellent in regard to the preservation of security.

What is claimed is:

1. A flash type sprinkler head, comprising:

a main body having a vertical center axis, including a screw portion for connection to a water pipe, and a brim portion;

a valve member comprising a valve cap and a gasket on said valve cap for releasably closing said outlet;

a heat sensitive member which disassembles in response to the heat of a fire;

a guide pin mounted on said heat sensitive member, a lower end of said valve member receiving said guide pin;

a frame screwably fixed to said brim portion of said main body, surrounding said outlet and said valve member and having a lower inner surface; said lower inner surface having a step portion, said frame supporting said heat sensitive member on said step portion;

spring means, between said guide pin and heat sensitive member, responsive to an upward pressure applied thereto by said frame through said heat sensitive member, for pressing said valve member upward through said guide pin and into said outlet to seal said outlet; and a heat conductive plate protectively surrounding said heat sensitive member, said heat conductor plate being disposed with no more than a slight vertical gap between a lower end of said frame and said heat conductive plate so as to abut said lower end of said frame if impacted from below;

said heat sensitive member including a pair of bending levers, each having radially outwardly extending portions at an upper end thereof and a lower portion at a lower end thereof, torque applying means for applying a torque to said levers in a direction tending to rotate the lower portions of said levers radially outward with respect to said axis, a setting plate laid over and engaging midportions of said levers between the upper and lower ends of said levers so as to separate said levers, a balancer engaging the lower portions of said levers so as to counteract said torque applied to said levers, a heat conductive cylinder having a top end and an open bottom end opposite said top end, said cylinder being fixed to said balancer so that said balancer is movable vertically downward therewith, a heat conductive piston having a heat portion in said cylinder closing said open bottom end of said cylinder and a rod portion connected to said heat portion and extending upwardly through said top end of said cylinder, a fusible segment which melts when exposed to the heat of a fire, disposed in said cylinder on said head portion so as to be vertically supported thereby, and means, operative with said rod portion, for holding said head portion up with respect to said setting plate to thereby hold said fusible segment up between and against said head portion and said top end of said cylinder and vertically support said cylinder and said balancer on said fusible element and said head portion, such that upon melting of said fusible element, said cylinder and said balancer therewith drops relative to said levers, thereby withdrawing the counteractive torque on said levers.

2. A sprinkler head as in claim 1, wherein said pair of bending levers are releasably supported on said step portion and apply an upward pressure on said spring means, such that upon melting of said fusible element, said outwardly extending portions of said levers rotate off of said step portion releasing the upward pressure on the spring means as said cylinder and balancer drops.

3. A sprinkler head as in claim 1, wherein said pair of bending levers are connected to said spring means and said step portion of said frame such that rotation of said lower portions of said levers radially outwardly with respect to said axis releases upward pressure on said valve member through said heat sensitive member so that said valve member separates from said outlet to open said outlet.

4. A sprinkler head as in claim 1, wherein said heat conductive plate has:

radially outward portions extending upward to oppose said lower end of said frame, and a bottom opening defined by a closed edge which extends into a peripheral groove in said cylinder adjacent said bottom opening of said cylinder, whereby said bottom opening is entirely exposed.

5. A sprinkler head as in claim 4, wherein said cylinder has side walls spaced from a peripheral surface of said head portion by a small gap such that said fusible segment is visible through said gap so as to permit creep of said fusible segment therein to be visually observed.

6. A sprinkler head as in claim 4, wherein said heat sensitive member further includes means defining an outlet for allowing the fusible segment to flow out of said sprinkler head at said head portion.

7. A sprinkler head as in claim 4, wherein said guide pin has an upper tip portion supporting said valve member, said tip end extending into said main body through said outlet.

* * * * *